United States Patent [19]

Staba

[11] 4,005,667

[45] Feb. 1, 1977

[54] WATERCRAFT WITH HYDROFOILS

[76] Inventor: Tomo Staba, Kleine Reichenstrasse 24, 2 Hamburg 11, Germany

[22] Filed: Mar. 25, 1975

[21] Appl. No.: 561,876

[30] Foreign Application Priority Data

Mar. 25, 1974 Switzerland ..... 4152/74

[52] U.S. Cl. ..... 114/283

[51] Int. Cl.[2] ..... B63B 35/44

[58] Field of Search ..... 114/66.5 R, 66.5 H, 114/126, 62, 67 R, 67 A

[56] References Cited

UNITED STATES PATENTS

| | | | |
|---|---|---|---|
| 2,336,987 | 12/1943 | Garber et al. | 114/66.5 R |
| 2,906,228 | 9/1959 | Wendel | 114/66.5 H |
| 3,125,981 | 3/1964 | Reynolds | 114/66.5 H |
| 3,236,202 | 2/1966 | Quady et al. | 114/66.5 H |
| 3,403,654 | 10/1968 | Wilson | 114/66.5 H |
| 3,820,490 | 6/1974 | Greer | 114/66.5 H |

FOREIGN PATENTS OR APPLICATIONS

| | | | |
|---|---|---|---|
| 6,299 | 3/1914 | United Kingdom | 114/66.5 H |
| 572,413 | 10/1945 | United Kingdom | 114/66.5 H |

*Primary Examiner*—Trygve M. Blix
*Assistant Examiner*—Stuart M. Goldstein
*Attorney, Agent, or Firm*—Beall & Jeffery

[57] ABSTRACT

The watercraft has a hull with an upwardly curved (concave) bottom and side keels extending downwardly for the full longitudinal length of the watercraft spaced laterally from each other and on opposite sides of the watercraft. Forward and rearward hydrofoils are arranged on either side of the hull and project from the keels for swivelling about generally vertical axes angled downwardly and outwardly. The hydrofoils on one side are adjustable independently of the hydrofoils on the other side for adjusting the angle of attack of the hydrofoil lifting surfaces that are curved outwardly to be generally horizontal. Fixed hydrofoils between and respectively longitudinally aligned with the adjustable hydrofoils are attached to the hull. Propellers that swivel about axes extending downwardly and outwardly at approximately 15° to the vertical are respectively mounted for swivelling movement along with attached rudders for steering. The hull is of aircraft frame construction, rests in the water and is lifted above the water by the hydrofoils during movement. A wave breaker is provided on the front of the hull.

12 Claims, 5 Drawing Figures

WATERCRAFT WITH HYDROFOILS

BACKGROUND OF THE INVENTION

The invention relates to a watercraft with hydrofoils.

Known watercraft with hydrofoils generally have two front and two rear hydrofoils which are interconnected in articulated manner in the centre underneath the watercraft. In this construction, the left-hand and right-hand hydrofoils move simultaneously. This type of watercraft has the disadvantage that when travelling at high speed, directional changes lead to a certain danger of capsizing. Furthermore, with known watercraft, the flow conditions are generally unsatisfactory so that high powered engines have to be used to enable the watercraft to move at high speed.

Boats are also known wherein controllable stabilizing wings, blades or fins are provided to prevent or at least reduce rolling when there is a heavy swell. However, these stabilizing wings do not lift the watercraft out of the water.

BRIEF SUMMARY OF THE INVENTION

The main object of the present invention is to provide a watercraft with hydrofoils that has improved travelling characteristics.

According to the invention, the watercraft has an upwardly curved bottom and the hydrofoils are arranged on either side of the hull of the watercraft.

As the hydrofoils are arranged on either side of the watercraft and not underneath the same, they act in similar manner to the runners of a sledge, so that a danger of capsizing scarcely exists. Nevertheless, the flow conditions are excellent because the water displaced by the lateral aerofoils does not strike against the walls of the watercraft but can instead flow freely underneath the same, because the watercraft has a flat or more advantageously an upwardly curved bottom.

The hydrofoils are preferably adjustable and it is particularly advantageous for the hydrofoils on one side of the watercraft to be adjustable substantially independently from the hydrofoils on the other side. This makes it possible, for example, on turning to the left where, as is known, a boat has the tendency to slope to the right to position the right-hand hydrofoil in such a way that the boat slopes to the left so that there is no danger of capsizing. It is thus possible with the watercraft according to the invention to perform relatively tight turns at high speeds.

If there are at least two pairs of adjustable hydrofoils it is advantageous to provide coupling devices for linking each front hydrofoil with the respective rear hydrofoil. This simplifies steering and controlling. The coupling need not take place in such a way that simultaneously the front and rear hydrofoils are swivelled and instead the rear hydrofoil can be swivelled with a time lag corresponding to the time between the front and rear hydrofoils striking a wave. This makes it possible to stabilize the watercraft.

According to an advantageous embodiment of the invention, the front and rear propellers are arranged behind the front or in front of the rear aerofoils, being coupled with a direction control device in such a way that on performing a direction change, the rear propellers are swivelled in the opposite direction to the front propellers. This makes it possible to take relatively tight turns.

BRIEF DESCRIPTION OF THE DRAWINGS

Other and further objects of the present invention will be apparent from the following description and claims and are illustrated in the accompanying drawings which by way of illustration show preferred embodiments of the present invention and the principles thereof and what now are considered to be the best modes contemplated for applying these principles. Other embodiments of the invention embodying the same or equivalent principles may be used and structural changes may be made as desired by those skilled in the art without departing from the present invention and the scope of the appended claims.

In the drawings.

DETAILED DESCRIPTION OF THE PREFERRED EMBODIMENTS

Figure 1:
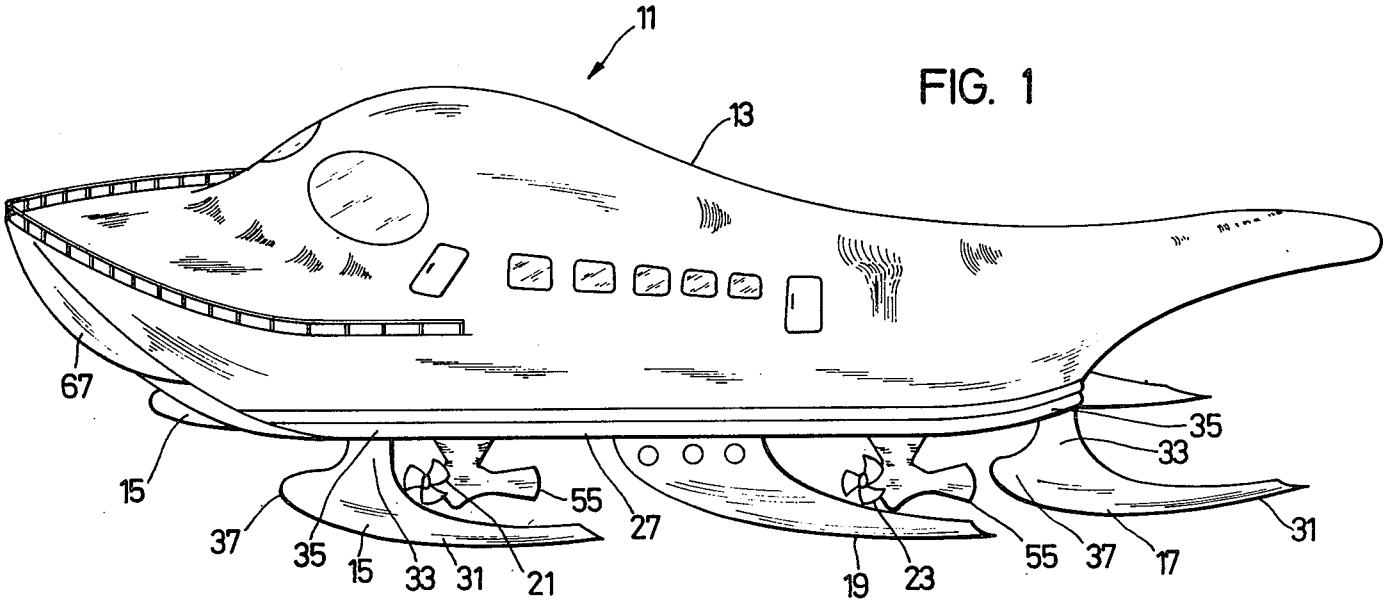
FIG. 1 shows a perspective view of a watercraft according to the invention.

In the embodiment of shown in FIG. 1, the hull 13 is constructed in similar manner to a pressure-resistant aircraft frame and has a pure aerodynamic form. However, other hull constructions are also possible. The watercraft 11 has front and rear adjustable hydrofoils 15, 17 arranged on either side. In the embodiment shown, a pair of fixed hydrofoils 19 are positioned between the front and rear adjustable pairs of hydrofoils 15, 17. A pair of front and a pair of rear propellers 21, 23 are positioned behind the front or in front of the rear hydrofoils 15, 17. Advantageously, each propeller has its own engine 45, as shown in FIG. 3.

Figure 2:
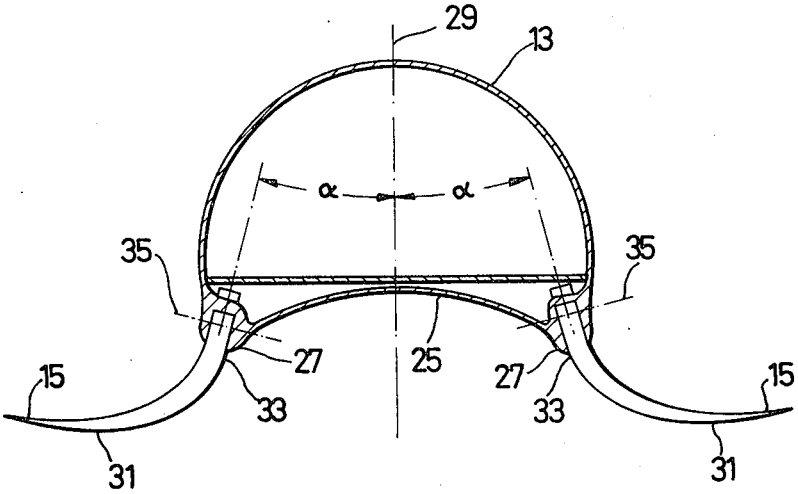
FIG. 2 shows a section through the hull and the hydrofoils.

As shown more particularly in the section according to FIG. 2, the watercraft 11 has a curved bottom 25. However, the bottom can also be flat instead of being curved. As a result of this arrangement, the waves from the hydrofoils 15, 17, 19 do not strike the hull.

Figure 3:
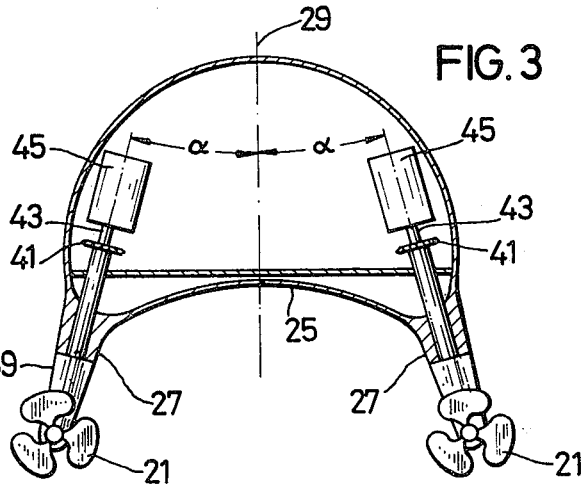
FIG. 3 shows a section through the hull, whereby the driving engines and the propeller swivelling means are shown.

A watercraft of the type shown in FIGS. 1 to 3 can also be considered as a boat with two keels, 27. The angle of inclination $\alpha$ of the keels is advantageously about 15° relative to the vertical plane of symmetry 29 of the watercraft. The width of the watercraft advantageously is a tenth of the length, but other proportions are also possible.

As can be seen particularly clearly in FIGS. 1 and 2, each adjustable hydrofoil 15, 17 has a paddle-shaped configuration. Hydrofoils 15, 17 substantially comprise a lifting surface 31 extending substantially parallel to the boat axis and acts in similar manner to a sledge runner or a water ski and an articulated portion 33 by means of which the hydrofoil is adjustably secured to the keel 27. FIG. 2 schematically shows the axes of rotation 35. The articulated portion 33 is located approximately in the first third or quarter of the lifting surface 31, so that the front portion 37 of the lifting surface is located in front of the axis of rotation 35. The adjustable aerofoils 15, 17 are advantageously slightly resilient and can be made, for example, from an at least partly hollow sheet steel structure.

In the construction shown in FIGS. 1 and 2, the articulated portions 33 of hydrofoils 15, 17 extend from the hydrofoil at an angle of about 15° relative to the vertical plane of symmetry thereof. The articulated portions 33 are curved in such a way that the lifting surfaces 31 are positioned approximately at right angles to the plane of symmetry 29. Advantageously, the lifting surfaces are also curved somewhat. Even though in the present description reference is made to an articulated portion and a lifting surface, it should be noted that the adjustable hydrofoils advantageously represent a unit. Hence a distinction is made between the lifting surface 31 and the articulated portion 33 with the sole purpose of providing a better understanding of the functions of the individual parts of the hydrofoil.

As shown in FIG. 3, the propellers 21, 23 are fitted to extensions 39 which project from the two keels 27 at an angle of about 15° relative to the plane of symmetry 29. The extensions 39 rotate about their axes so that the extension 39 can be pivoted, whereby naturally the direction in which propellers 21, 23 operate also changes. As shown schematically in FIGS. 3 and 4, the pivoting can for example take place by means of a sprocket wheel 41 which is attached to extension 39.

FIG. 3 also shows the driving shaft 43 and the engine 45. Thus, engine 45 can drive the propellers 21, 23 via driving shaft 43, and a not shown bevel gearing.

Figure 4:
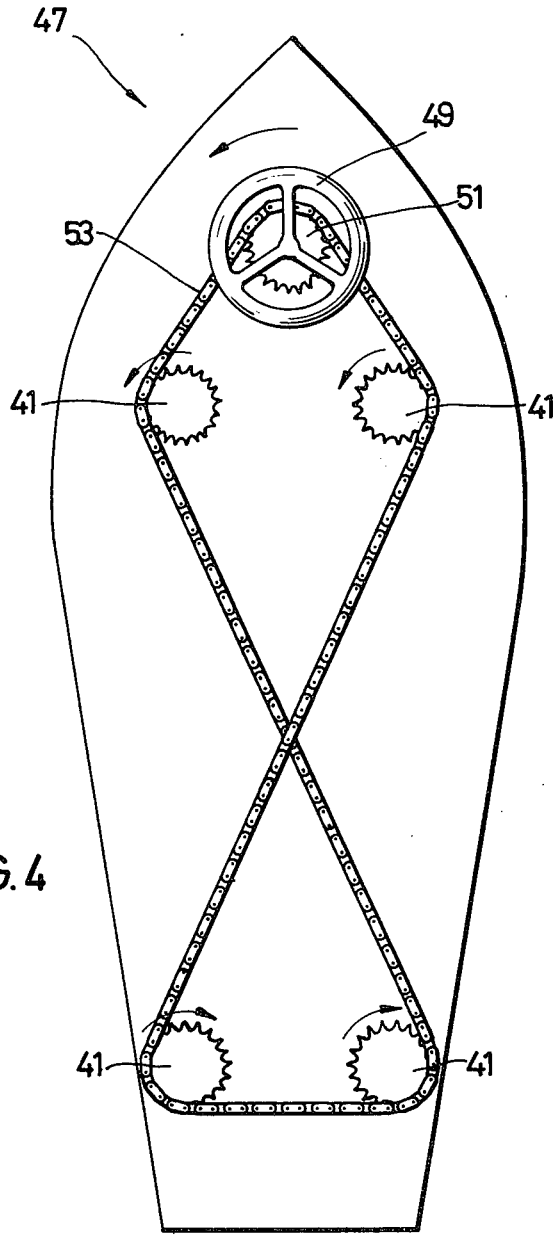
FIG. 4 shows a schematic view of the control means for swivelling the propellers.

FIG. 4 shows a direction control device 47 for four propellers, i.e. for pivoting the extensions 39 with propellers 21, 23 as shown in FIG. 3. This direction control device 47 substantially comprises a steering wheel 49 which is coupled with a sprocket wheel 51 over which a chain 53 is guided in such a way that it drives the sprocket wheels 41 which have already been mentioned in conjunction with FIG. 3 so that on performing a change of direction, the rear propellers 23 in FIG. 1 are swivelled in the opposite direction to the front propellers. Consequently, even when travelling at high speed, direction changes can rapidly be performed because the front propellers move the front of the watercraft and the rear propellers the back of the watercraft in opposite directions. It is also possible to turn the watercraft without moving it forwardly or backwardly.

It should also be noted that a rudder 55 is fixed to extension 39 and this is particularly effective when travelling at low speed or when the propellers are not operating.

Figure 5:
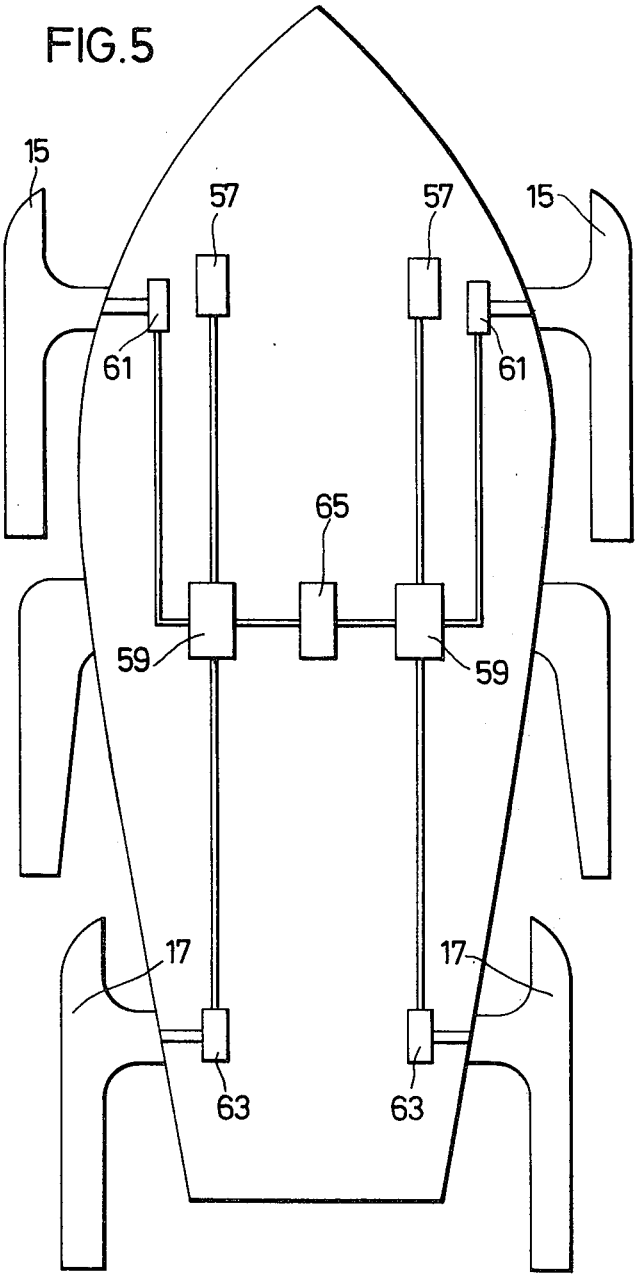
FIG. 5 shows a schematic view of the control means for operating the swivellable hydrofoils.

As in each pair of hydrofoils 15, 17 each individual hydrofoil can be adjusted independent of the other, this provides the possibility, e.g. when making a turn, to swivel one hydrofoil more than the other, i.e. raising the the watercraft further out of the water on one side than on the other. Thus, the watercraft is very manoeuvrable even at high speeds. If the watercraft has front and rear hyrofoils, a coupling device is advantageously provided so that by means of a control member, both the front and rear hydrofoils can be controlled. FIG. 5 schematically shows the possible positioning of the control means for operating the swivellable hydrofoils. Pedals 57 or some other control member are provided in order to raise or lower the hydrofoils 15 or 17 on the right-hand or left-hand sides by means of the right and left foot or arm. Pedal 57 operates, for example, hydraulically on a coupling device 59 which in turn is connected with the swivel device, e.g. a hydraulic cylinder 61, 63. The coupling device 59 can thereby be constructed in such a way that the movements of the rear hydrofoil 17 take place with a certain time lag relative to the movements of the front hydrofoil 15, which is particularly advantageous if the setting of the hydrofoils can be changed in accordance with the swell. The time lag should be set in such a way that it corresponds to the time necessary for the watercraft to traverse the area corresponding to the distance between the front and rear hydrofoils. Fundamentally, the control system can also be such that it automatically operates the hydrofoils, e.g. hydraulically in bad weather in order to keep the watercraft horizontal. To avoid an undesired sloping position of the hydrofoil by unskilled operation of the pedals 57, a further coupling device 65 can be provided which links the coupling devices 59 for the right and left-hand sides and in the case of an extreme operation of a pedal 57 ensures that it is not only the hydrofoils on one side of the watercraft which are raised but that also the hydrofoils on the other side are raised to a certain extent.

It is also possible for the steering wheel 49 in FIG. 4 to act on the coupling devices 59 in place of the pedals 57, so that on changing direction the hydrofoils on one side of the watercraft are raised more than those on the other side.

Finally, it is pointed out that a central wave breaker 67 is provided on hull 13.

It is further pointed out that the watercraft according to the invention, if it is constructed in the manner of a pressure-resistant frame, e.g. like an aircraft or submarine frame, can also briefly be submerged if the hydrofoils are directed downwards. In such an angular position, the forces acting on the hydrofoils counteract aerodynamic lift so that the watercraft is submerged.

Depending on the envisaged application, the watercraft can be constructed in different sizes and designs.

While there has been described and illustrated the preferred embodiments of the invention, it is to be understood that these are capable of variation and modification and it is not therefore desired to be limited to the precise details set forth but to include such modifications and alterations as fall within the scope of the appended claims.

What is claimed is:

1. A watercraft, comprising: only a single one-piece hull having a longitudinal axis of symmetry and opposite sides; at least two pairs of adjustable hydrofoils having lifting surfaces and being respectively mounted beneath and on opposite sides of said hull; a plurality of propellers respectively arranged adjacent at least one pair of said hydrofoils; means for swivelling said propellers about respective generally vertical axes for changing the travelling direction of said watercraft; said hull having two side keels arranged in lateral spaced relationship with respect to each other and each extending substantially the entire longitudinal length of the watercraft, and a bottom shaped concavely in an upward direction and extending between said two keels; said bottom lying below the normal water level when the watercraft is at rest; means including said propellers said concave bottom and said hydrofoils for lifting said watercraft upwardly and lifting said bottom above the water level during driving of the watercraft by said propellers; means for pivotally mounting one pair of hydrofoils on one keel so as to have front and rear hydrofoils on the one keel, and the other pair of hydrofoils on the other keel so as to have front and rear hydrofoils on the other keel; each of said hydrofoils having a portion extending downwardly from its keel at an angle with respect to the longitudinal vertical plane of symmetry of said hull and a curved lifting surface portion curving outwardly from said downwardly extending portion so that in each position of the boat and hydrofoil the lifting surface extends generally horizontally and approximately at right angles to the longitudinal plane of symmetry with an angle of attack relative to the surface of the water; and said means for mounting the hydrofoils also adjusting the angle of attack of the lifting surfaces relative to the surface of the water.

2. The watercraft according to claim 1, including means drivingly coupling each front hydrofoil with the respective longitudinally aligned rear hydrofoil on the same side for coordinated adjustment.

3. The watercraft according to claim 2, including means for drivingly coupling the hydrofoils on the one side of the watercraft with those on the other side of the watercraft for coordinated adjustment.

4. The watercraft according to claim 1, including additional fixed hydrofoils mounted beneath said hull.

5. The watercraft according to claim 1, including a pair of fixed hydrofoils mounted beneath said hull and longitudinally aligned between respectively said front and rear adjustable hydrofoils.

6. The watercraft according to claim 1, including a bow on said hull and a central wave breaker on the bow of said hull.

7. The watercraft according to claim 1, wherein said hull is constructed in the manner of a pressure-resistant aircraft frame.

8. The watercraft according to claim 1, wherein there are front propellers positioned behind the front hydrofoils, respectively, and there are additional rear propellers positioned in front of the rear hydrofoils, respectively and to the rear, respectively, of said front propellers; and direction control means drivingly coupling said propellers so that when said propellers are swivelled for changing direction, the rear propellers are swivelled in the opposite direction to the front propellers.

9. The watercraft according to claim 8, wherein said means for swivelling said propellers swivels said propellers independently of and with respect to said hydrofoils.

10. The watercraft according to claim 9, including a rudder adjacent to and connected to each said propeller for swivelling with each of said propellers.

11. The watercraft according to claim 1, wherein said means for adjusting said hydrofoils pivots each of said hydrofoils about a generally horizontal axis extending upwardly and outwardly at an acute angle with respect to the horizontal.

12. The watercraft of claim 1, wherein said propellers are located behind at least some of said hydrofoils.

* * * * *